United States Patent [19]

Leitner

[11] 4,443,903

[45] Apr. 24, 1984

[54] COMPOSITE UPHOLSTERED FURNITURE OR MATTRESS ASSEMBLY WITH FLAME RETARDANT-SMOLDER RESISTANT TEXTILE BACKCOATED FABRIC LAYER

[75] Inventor: George J. Leitner, Peekskill, N.Y.

[73] Assignee: Stauffer Chemical Company, Westport, Conn.

[21] Appl. No.: 488,500

[22] Filed: Apr. 25, 1983

Related U.S. Application Data

[62] Division of Ser. No. 297,549, Aug. 31, 1981, Pat. No. 4,404,313.

[51] Int. Cl.[3] ..... A47C 27/00; B32B 7/00; B32B 27/42

[52] U.S. Cl. ..... 5/459; 5/483; 5/297; 5/DIG. 1; 2/81; 428/248; 428/262; 428/264; 428/276; 428/290; 428/277; 428/920; 428/510; 428/526; 428/527; 524/512

[58] Field of Search ..... 5/483, 459; 428/248, 428/264, 262, 276, 290, 277, 920

[56] References Cited

U.S. PATENT DOCUMENTS 3,273,177 9/1966 Newton ..... 5/483 X
3,969,437 7/1976 Shim ..... 428/276

FOREIGN PATENT DOCUMENTS 1178718 1/1970 United Kingdom .

*Primary Examiner*—P. Ives
*Attorney, Agent, or Firm*—Vivienne T. White

[57] ABSTRACT

The invention provides a process for rendering textiles or barrier fabric material flame retardant and smolder resistant with a flame retardant and smolder resistant composition comprised of an aminophosponate ester in combination with a thermosetting, nitrogen-containing resin and preferably a reactive elastomeric latex.

12 Claims, No Drawings

COMPOSITE UPHOLSTERED FURNITURE OR MATTRESS ASSEMBLY WITH FLAME RETARDANT-SMOLDER RESISTANT TEXTILE BACKCOATED FABRIC LAYER

This is a division of application Ser. No. 297,549 filed Aug. 31, 1981, now U.S. Pat. No. 4,404,313.

BACKGROUND OF THE INVENTION

1. Field of the Invention

This invention relates to flame retardant and smolder resistant compositions for backcoating textile or interliner materials. More particularly, this invention relates to rendering textiles, generally upholstery textiles or upholstery interliner materials, flame retardant and smolder resistant.

2. Relevant Art

By textile is meant, hereinafter, a fabric, filament, staple, or yarn, or products made therefrom, which may be woven or non-woven.

Rendering textiles flame retardant or smolder resistant is of importance for the improvement of the safety characteristics of apparel, bedding, protective clothing, tents, cloth, carpets, home furnishings, aircraft and automobile interior fabrics, and industrial fabrics which may be woven, knitted, tufted and non-woven.

Fire hazards associated with upholstered furniture are well known, and little has been done in changing the smoldering characteristics by imparting smolder resistance to such fabrics.

Presently upholstery fabric is backcoated for dimensional stability and to improve wearability utilizing various polymeric materials. Some chlorine-containing polymers have been found to be smolder retardants when used as backcoatings, Donaldson, Mard and Harper, *Imparting Smolder Resistance to Cotton Upholstery Fabric,* Textile Research Journal 49, 185–190 (1979). The use of these polymers in backcoating, is, however, not satisfactory due to high levels of add-ons necessary to achieve the smoldering resistance for adequate protection. Furthermore, these high levels result in objectionable aesthetics (hand) to the treated material.

It has also been disclosed to utilize boric acid, by dusting or vapor phase methyl borate hydrolysis techniques, to impart smolder resistance at relatively low add-ons. Commercial use of this process has, however, been hindered by the problem of permanence, availability of application equipment and cost. In an attempt to overcome the cost and equipment factors of utilizing boric acid, a smolder resistant finish based on borax has been suggested, see Donaldson and Harper, *A Borax-Nitrogen-Phosphorous System For Imparting Smolder Resistance to Upholstery Fabrics,* Journal of Consumer Products Flammability, Vol. 7, No 1, 40–47 (March 1980). This method provides for dissolving the less costly borax in phosphoric acid and applying the mexture in combination with methylolated melamine via a pad, dry-cure procedure.

It has further been disclosed to utilize sulfur to impart smolder resistance to upholstery fabrics. This, however, has caused odor problems.

U.S. Pat. No. 3,746,572 to Weil et al. discloses a process for flame retarding textiles comprising applying to the textile an aqueous solution consisting of a polyol phosphonate, dimethylol dihydroxyethylene urea and a curing catalyst and curing the phosphonate and urea on the textile and thereby rendering the textile flame retardant. The method of application is by padding and thereby impregnating the fabric with the flame retardant material. Although this process provides adequate flame retardant properties, it cannot be used satisfactorily to provide smolder retardance particularly in upholstery fabric. A wet impregnation of upholstery fabric would be injurious to fabric hand as well as costly in the chemicals utilized, and the energy expended for drying. In addition, applications of this type on velvets would negate the asthetic appeal of this soft pile fabric.

SUMMARY OF THE INVENTION

The present invention provides a process for rendering textile flame retardant and smolder resistant which leaves the fabric with a soft, tactile character and good physical strength properties. The present process comprises backcoating textiles such as upholstery fabric or upholstery interliner material with a composition containing an effective amount of a primary aminophosphonate ester of the formula:

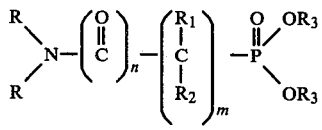

wherein R is an alkyl or hydroxyalkyl or haloalkyl containing from 1 to 3 carbon atoms, $R_1$ and $R_2$ are alkyl radicals containing from 1 to 6 carbon atoms or hydrogen, $R_3$ which may be the same or different is an alkyl, hydroxyalkyl, haloalkyl, alkoxyalkyl or hydroxyalkoxyalkyl of 1 to 6 carbon atoms, the terminus of an alkylene forming a six-membered ring or halogenated analogs, the terminus of an alkylene or alkyleneoxyalkylene bonded to a like phosphorus ester group, hydroxypolyoxyalkylene or hydroxy-substituted analogs thereof, n is an integer from 0–1 and m is an integer of 1–2. Particularly suitable aminophosphonate esters for use in practicing the invention are

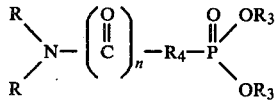

wherein R is an alkyl, hydroxyalkyl or haloalkyl containing from 1 to 3 carbon atoms, $R_3$ which may be the same or different is an alkyl radical containing from 1 to 6 carbon atoms, $R_4$ is an alkylene of from 1 to 3 carbon atoms and n is an integer of from 0–1, the most preferred compound being diethyl N, N-bis (2-hydroxyethyl) aminomethylphosphonate or analogs thereof. The invention comprises utilizing an aminophosphonate ester of the type disclosed herein in combination with a thermoset, nigrogen-containing resin and preferably with the addition of reactive elastomeric latex. The invention is also a flame and smolder retardant composition comprising the aminophosphonate compound and a nitrogen-containing resin preferably also comprising a reactive latex composition. The application of such a flame retardant and smolder resistant composition to the upholstery fabric or a barrier fabric (interliner material) woven or non-woven, of natural or synthetic fiber, or blends of both, will render the fabric smolder resistant the flame retardant.

The present process is useful for rendering textiles flame retardant and smolder resistant, especially cellulosic textile material, including cotton, corduroy, velvet brocade and polyester-cotton blends, viscose rayon, jute and products made from wood pulp.

The invention although applicable to all textiled fabrics is particularly applicable to upholstery textiles such as furniture, auto, bedding (mattress) and interliner materials utilized therewith.

DETAILED DESCRIPTION OF THE INVENTION

The present invention pertains to a process for rendering textile material flame retardant and smolder resistant. It is particularly directed to backcoating upholstery fabric and upholstery interliner or barrier fabric material with the flame retardant and smolder resistant composition. According to the present invention, it has been unexpectedly found that an amino phosphonate ester having the structure:

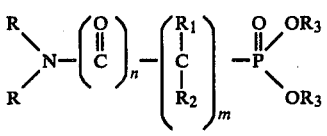

(I)

wherein R is an alkyl, hydroxyalkyl or haloalkyl radical containing from 1 to 3 carbon atoms, $R_1$ and $R_2$ are alkyl radicals containing from 1 to 6 carbon atoms or hydrogen, $R_3$ which can be the same or different is an alkyl, hydroxyalkyl, haloalkyl, alkoxyalkyl or hydroxyalkoxyalkyl of 1 to 6 carbon atoms, the terminus of an alkylene forming a six-membered ring or halogenated analogs, the terminus of an alkylene or alkyleneoxyalkylene bonded to a like phosphorus ester group, hydroxypolyoxyalkylene or hydroxy-substituted analogs thereof, n is an integer from 0–1 and m is an integer from 1–2. Examples of the phosphorus derivatives of this group are disclosed in U.S. Pat. No. 3,746,572, incorporated herein by reference.

The flame retardant and smolder resistant composition of the present invention utilizes relatively low molecular weight aminophosphonate ester compounds with both phosphorus and nitrogen in its structure. These aminophosphonate esters are particularly suitable for providing flame retardancy and smolder resistance to upholstery fabrics.

The term amino is broadly utilized herein to cover amine and amide groups. The flame retardant composition can be utilized to backcoat the outermost layer of the upholstery assembly or a fabric interliner layer (barrier layer) in contact with the outermost layer. In the process of the invention, the aminophosphonate ester is combined with a thermosetting nigrogen-containing resin which can be applied as is or preferable in combination with a reactive elastomeric copolymer latex composition.

These compounds useful in the practice of the invention generally impart a higher degree of flame retardance relative to their phosphorus content than do non-amine derived compounds. Their synthesis and use for other purposes are described in U.S. Pat. Nos. 3,076,019; 3,457,333 and 3,294,710; and British Pat. No. 1,178,718, all incorporated herein by reference.

The preferred group of compounds within the amino phosphonate ester composition disclosed herein are

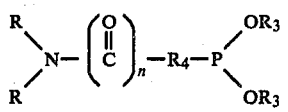

II wherein R is an alkyl, hydroxyalkyl or haloalkyl containing from 1 to 3 carbon atoms, $R_3$ which can be the same or different is an alkyl radical containing from 1 to 6 carbon atoms, $R_4$ is an alkyl radical containing from 1 to 3 carbon atoms, and n is an integer of from 0–1.

A narrow preferred subgroup having good flame retardant efficacy is:

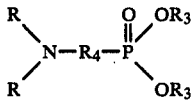

III wherein R is an alkyl, hydroxyalkyl or haloalkyl radical containing from 2 to 3 carbon atoms, $R_4$ is an alkylene radical containing from 1 to 2 carbon atoms and $R_3$ which can be the same or different is an alkyl radical containing from 1 to 2 carbon atoms.

This class of compounds can be prepared in the manner disclosed in U.S. Pat. No. 3,076,010 incorporated herein by reference and in accordance with the following general reaction:

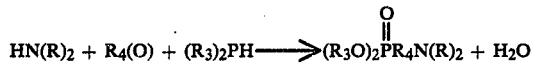

wherein R, $R_3$ and $R_4$ are the same as in III above and $R_4$ (O) represents an aldehyde or a ketone. Briefly, this reaction may be said to involve the reaction of a dialkanolamine, a monoalkylalkanolamine, or a dialkyl amine, an aldehyde or ketone, and a dialkyl phosphite. Suitable dialkanolamines for the purpose of this invention include such compounds as diethanolamine, dipropanolamine, ethanol propanolamine, and the like.

Suitable aldehydes or ketones are such well-known compounds as formaldehyde, acetaldehyde, butyraldehyde, furfural, acetone, methyl ethyl ketone, and the like.

Dialkyl phosphites which are suitable are dimethyl phosphite, diethyl phosphite, methyl ethyl phosphite, and dipropyl phosphite and the like.

The preferred phosphonates for use in the present invention are the compounds:

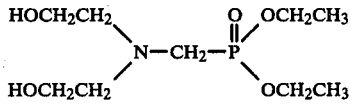

V

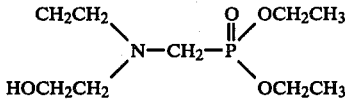

VI

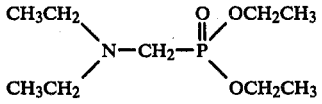

VII

In the process of the invention, it is preferred for reasons of improved durability to have at least one and preferably two or more carbon bonded primary alcohol groups in the phosphorous reagent, and for reasons of avoiding excessive crosslinking, to have no more than six suchgroups in the molecule. The most preferred phosphonate for use in the practice of the invention is diethyl N,N-bis (2-hydroxyethyl) aminomethylphosphonate of formula V above, (which compound is sold under the tradename FYROL ® 6 by Stauffer Chemical Company), because of its excellent flame retardant efficacy.

Other ingredients which are added to the backcoating composition of the present invention are a suitable nitrogen-containing thermosetting resin such as melamine-formaldehyde resins, urea-formaldehyde resins, carbamate or glyoxal based nigrogen-containing resins.

Preferred melamine-formaldehyde resins are tris (methoxymethyl) melamine (AEROTEX ® M-3) partially methylated pentamethylmelamine (AEROTEX ® 23 SPECIAL), and hexamethoxymethylmelamine (CYMEL ® 301).

In addition, a suitable reactive elastomeric latex can be and preferably is added to the composition for backcoating upholstery fabric or upholstery barrier fabrics. Some suitable monomers for these latex compositions are, ethyl acrylate
butylacrylate
glycidyl methacrylate
N-methylolacrylamide
acrylonitrile
acrylic acid
2-hydroxyethyl acrylate
ethylene dimethacrylate
vinyl acetate
butyl acetate The following are suitable reactive copolymer latex composition for use in formulating the flame and smolder retardant back coating compositions of the invention:

(a) ethyl acrylate/butylacrylate/glycidyl methacrylate/N-methylolacrylamide (67.5%/25%/3.75%/3.75%).
(b) ethyl acrylate/acrylonitrile/acrylic acid/N-methylolacrylamide (84/10/3/3).
(c) butylacrylate/acrylonitrite/2 hydroxyethyl acrylate/ethylene dimethacrylate/methacrylic acid (86.6/5/3/0.4).
(d) vinyl acetate/ethylene/itoconic acid (83/15/2).
(e) butyl acetate/methyl methacrylate/acrylic acid (65/30/5).
(f) ethyl acrylate/methyl methacrylate/2-hydroxyethyl acrylate (75/20/5).
(g) butadiene/styrene/acrylic acid (65/32/3).

Organophosphorus compounds of the type disclosed herein, which are water soluble reactive organophosphorus compounds, are particularly effective as flame retardants in combination with the N-containing resin and the latex backcoating. The latex coating also enhances the smolder resistance by functioning as a heat sink to dissipate the heat from a smoldering source.

In addition to the above, other optional agents which can be added to the flame and smolder retardant composition of the invention are buffers, thickners, and the like. Other agents which may be added are urea and dicyanamide, nitrogen sources, which function synergisticaly with the organo-phosphorus compounds of the invention to augment the thermoseting nitrogen-containing resins. In addition, there can be added a monoammonium and diammonium phosphate mixture which, when incorporated into the compositions of the invention, acts as a buffer to maintain the desired pH level, and as a catalyst causing the thermosetting resin to crosslink with the reactive latex at lowering curing temperatures. Another agent which is also preferably incorporated into the back coating composition is ammonium hydroxide which partially solubilizes the polycarboxylic acrylate thickners, resulting in a viscosity increase of the backcoating formulation. Thickners can also be used, as for example, methyl cellulose, casein, ammonium alginate, sodium or ammonium polyacrylate (ACRYSOL), polycarboxylic acrylates, hydroxyethyl cellulose (NATRASOL).

The backcoating composition of the invention can comprise water and the following:

| Composition | Parts by Weight |
|---|---|
| Reactive latex copolymer | 30–65 |
| Thermoset nitrogen containing resin | 2–15 |
| Buffers/catalysts | 0–5 |
| Thickners | 0–3 |
| Aminophosphonate ester | 5–30 |
| Other buffers | 0.5–2 |
| Thickners | 0–3 |

A preferred flame and smolder resistant formulation of the invention is:

| Composition | Parts by Weight |
|---|---|
| Water | 24.0 |
| Reactive acrylate copolymer latex (RHOPLEX ® TR 520) | 50.0 |
| Tris (methoxymethyl) melamine (AEROTEX ® M-3) | 7.0 |
| Mono/diammonium phosphate (FYREX ® 25% Solution) | 2.0 |
| Ammonium polyacrylate (ACRYSOL ® ASE-95) | 0.75 |
| Hydroxyethyl cellulose (NATROSOL ® 250HR) | 0.25 |
| Diethyl N, N—bis (2-hydroxyethyl) aminomethyl-phosphonate (FYROL ® 6) | 15.0 |
| Ammonium hydroxide | 1.0 |
| | 100. |

The above formulation is representative of a preferred backcoating composition of the invention. It is within the knowledge of one skilled in the art to vary the proportions of the various compositions contained therein to obtain other effective formulations within the scope of the invention.

The aminophosphonate ester content, for instance, may be varied to comprise from about 5% to about 30% of the backcoating compositions. In such instances, the concentration of the crosslinking agent should be similarly varied to obtain a formulation having a suitable viscosity necessary for adequate application to the textile. The viscosity should be such that the composition will flow but not penetrate deeply into the fabric.

In the formulation, the crosslinking resin agent (thermo-setting) is also used to bind the aminophosphonate ester to the fabric substrate and/or the reactive copolymer latex.

The hydroxyl groups of the aminophosphonate ester can function to cause the backcoating composition when applied to have a somewhat hydrophilic characteristic which can cause the treated fabric to have a tackiness to the hand. In such instances addition of more of the crosslinking agent to the formulation will eliminate the tacky feel by reacting with the hydroxyl groups.

The backcoating composition can be applied by knife-coating, kiss roller coating or spray techniques.

After application of the backcoating, the composition is fixed to the treated textile by curing. By "curing" is meant the formation of a water-insoluble polymeric finish by the co-reaction of the aminophosphonate ester and the nitrogen-containing resin, preferably including a reactive copolymer latex composition.

Curing of the backcoated textile may be accomplished by maintaining the treated fabric for a period of time of from about 1 hour to 10 days at ambient temperature or, a more rapid cure may be affected by the application of heat at temperatures of 250° to about 350° F. (120°-176.5° C.). Under the latter conditions, a cure time as short as only about 1 minute may be required.

The invention is particularly directed to flame and smolder resistant upholstery textiles generally associated with a composite upholstery furniture comprised of several layers wherein the inside surface of the outermost normally smolder prone layer, or an interliner fabric layer (barrier fabric) in intimate contact with the outermost layer is backcoated with a flame and smolder resistant composition.

Upholstered Furniture Action Council (UFAC) fabric classification and barrier test methods were utilized in the following examples.

The UFAC classification test method comprises the use of equipment similar to that used in the National Bureau of Standards (NBS) fabric classification test.

In the UFAC classification test method, fabric is mounted on vertical and horizontal panels of 2 inch thick polyurethane substrates. The panels are then placed in mock up test assemblies and lighted cigarettes covered with sheeting material are allowed to burn in the crevice formed by the abutment of the panels in a minature chair. The evaluation of the fabric is accomplished by measuring the length of the fabric char from the crevice upward in the horizontal panel composite. Fabric specimens which do not ignite and does not yield a char of 4.5 cm (1.75 in.) or greater, is classified as Class I cover fabric. If the fabric ignites or the char is equal to or greater than 4.5 cm, the fabric is a Class II fabric.

Class II fabrics under UFAC (Upholstered Furniture Action Council) program cannot be used in direct contact with conventional polyurethane in horizontal seating surfaces. As a result, a suitable barrier fabric material (interliner) is generally inter-positioned to shield the polyurethane and/or conduct the heat away from the Class II upholstery outermost layer. The UFAC Barrier test method defining the performance of the upholstery interliner material for use with class II outermost upholstery fabric is discussed below.

Barrier Test Method

This test method comprises mounting a barrier fabric between a standard Class II cover fabric (100% cotton) and the vertical and horizontal polyurethane substrate. As in the classification test, a lighted cigarette is placed in a crevice formed by the abutment of the polyurethane panels and a piece of sheeting material is used to cover the cigarette. If ignition of the polyurethane substrate occurs, the barrier fabric is a failure, likewise if no ignition of the substrate occurs, the barrier fabric is suitable as a barrier fabric with Class II fabric and conventional urethane in horizontal seating surfaces.

A full description of the above fabric classification test and the Barrier test are available from the UFAC, Box 2436, High Point, NC 27261.

Advantageously, in the practice of the invention, increased smolder resistance and flame retardancy is obtained at a significantly lower level of add-ons thereby preserving the original fabric aesthetics. The lower add-on level is a result of the presence of both phosphorus and nitrogen in the molecule which causes it to respond synergistically to enhance smolder retardance. Add-ons of from about 0.2 oz/yd$^2$ to about 3.5 oz/yd$^2$ or (0.0068/kg/m$^2$) to (0.12 kg/m$^2$) have been found sufficient to provide effective flame and smolder retardant protection. Similar organophosphorus compounds that do not contain amino groups were found to be less efficient smolder retardants when evaluated on an equal phosphorus level.

It is apparent that many modifications and variations of the invention are hereinbefore set forth may be made without departing from the spirit and scope thereof; and therefore, only such limitations should be imposed as are indicated in the appended claims.

EXAMPLE 1

An upholstery backcoating composition containing 50% by weight of a reactive acrylate copolymer latex (Walsh Chemical's WRL-148), 7% of an 80% active methyol malamine formaldehyde (AEROTEX M-3) resin, 0.5% of a mixture of mono and diammonium phosphate (FYREX), 1% thickening agents, 15% diethyl-N, N-bis (ethyl) aminomethyl phosphonate (Fyrol 6) and 1% ammonium hydroxide and 25.5% water was prepared with mixing by mechanical agitation. This backcoating composition had a pH of 8.7 and a Brookfield viscosity (Model RTV, Spindle 6, speed 10) of 8300 cps. It was applied by the knife coating technique to the back of a 13.1 oz/yd.$^2$ (0.44 kg/m$^2$) cotton corduroy and a 16.2 oz/yd.$^2$ (0.55 kg/m$^2$) 54%/44% rayon/-cotton blend velvet. The coatings were dry-cured in a conventional oven at 300° F. (149° C.) for 6 minutes. The dry weight coating add-ons were 2.4 oz/yd.$^2$ (0.08 kg/m$^2$) on the corduroy, and 3.3 oz/yd.$^2$ (0.11 kg/m$^2$) on the velvet. When tested for cigarette smolder resistance in the standard UFAC fabric classification test, both fabrics were rated as Class I, smolder resistant.

EXAMPLE 2

As in Example 1, the active organophosphorus compound was diethyl-N,N-(ethyl, hydroxyethyl-)aminomethyl phosphonate. The resulting backcoating mix had a pH of 8.9 and a Brookfield viscosity of 8,000 cps. Applied to the same two fabrics and dry-cured at the same conditions, dry weight add-ons of 2.6 oz/yd.$^2$ (0.088 kg/m$^2$) on the corduory and 2.8 oz/yd.$^2$ (0.095 kg/m$^2$) on the velvet were obtained. Both backcoated fabric samples were rated as Class I in the UFAC fabric classification test.

EXAMPLE 3

A smolder-resistant backcoating composition was prepared by mixing together 50 parts of a reactive acrylate copolymer (Rhoplex TR520), 5 parts of an 80% active trimethylol melamine (Aerotex M-3), 0.5 parts of diammonium phosphate, 1 part of a polycarboxylic acrylate thickener, 15 parts of diethyl N,N-bis (hydroxyethyl) aminomethyl phosphonate (FYROL 6), 1 part of ammonium hydroxide and 27.5 parts of water. The resulting product had a pH of 7.8 and a viscosity of 10,500 cps. (Brookfield Model RTV, Spindle 6, Speed 10). This emulsion coating was applied via a hand-drawn knife applicator on a 100% cotton corduroy and a 100% rayon brocade fabric, each weighing 13.1 oz-/yd.$^2$ (0.44 kg/m$^2$) and dry-cured at 350° F. (177.5° C.) for 3 minutes. With respective dry add-ons of 3.0 oz-/yd.$^2$ (0.10 kg/m$^2$) and 3.4 oz/yd.$^2$, (0.13 kg./m$^2$) Class I UFAC rating were obtained in the smoldering cigarette fabric classification test.

EXAMPLE 4

A smolder retardant backcoating composition was formulated with 56 parts of a reactive acrylic copolymer latex (Rhoplex HA-24), 5.6 parts of methylol melamine-formaldehyde resin, 0.5 parts of diammonium phosphate, 1.25 parts of a latex thickening agent, 15 parts of diethyl N,N-bis (hydroxyethyl) aminomethyl phosphonate, 1 part of ammonium hydroxide and 19.5 parts of water. The backcoating emulsion had a pH of 8.9 and a Brookfield viscosity of 14,000 cps. This formulation was then augmented by adding 5% of a 30% active ammonium stearate frothing aid. The mixture was frothed with a wire beater on a Hobard mixer to an 80 cup density and applied to two lightweight Class II fabrics by the knife coating technique. The coated fabrics were dry-cured in a curing oven at 325° F. (163° C.) for 4 minutes. The damask, a 7.2 oz/yd.$^2$ (0.24 kg/m$^2$) 100% cotton fabric, and a corded broadcloth, a 9.8 oz/yd.$^2$ (0.33 kg/m$^2$) 78%cotton, 22% rayon fabric blend had add-ons of 0.2 oz/yd.$^2$ (0.0068 kg/m$^2$) and 0.6 oz/yd.$^2$ (0.02 kg/m$^2$) respectively. Both fabrics were soft of hand and retained their breathability (air porosity) properties. Both fabrics when subjected to the UFAC fabric classification test were found to be upgraded to Class I.

What is claimed:

1. A composite upholstered furniture or mattress assembly comprising layers of material wherein the inside surface of the outermost normally smolder prone layer is in intimate contact with a fabric layer backcoated with an effective amount of a flame and smolder retardant composition comprising an aminophosphonate ester of the formula:

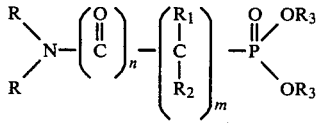

in combination with a thermosetting nitrogen containing resin and a reactive latex copolymer compound wherein R is an alkyl, hydroxyalkyl or haloalkyl radical containing from 1 to 3 carbon atoms, $R_1$ and $R_2$ are alkyl radicals containing 1 to 6 carbon atoms or hydrogen, $R_3$ which may be the same or different is an alkyl, hydroxyalkyl, haloalkyl, alkoxyalkyl, or hydroxyalkoxyalkyl radical containing from 1 to 6 carbon atoms, the terminus of an alkylene forming a six-membered ring or halogenated analog, the terminus of an alkylene or alkyleneoxyalkylene bonded to a like phosphorus ester group, hydroxypolyoxyalkylene or hydroxy-substituted analogs thereof, n is an integer from 0–1 and m is an integer of 1–2.

2. The composite of claim 1 wherein the aminophosphonate ester of the flame and smolder retardant composition has the formula:

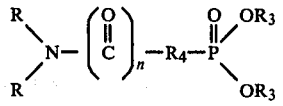

wherein R is an alkyl, hydroxyalkyl or haloalkyl radical containing from 1 to 3 carbon atoms, $R_3$ which may be the same or different is an alkyl radical containing from 1 to 6 carbon atoms, $R_4$ is a straight chain alkylene radical containing from 1 to 2 carbon atoms, and n is an integer of from 0 to 1.

3. The composite of claim 2 wherein the aminophosphonate ester has the formula:

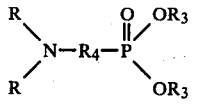

wherein R is an alkyl hydroxyalkyl or haloalkyl radical from 2 to 3 carbon atoms, $R_4$ is an alkylene radical containing from 1 to 2 carbon atoms, $R_3$ is an alkyl radical containing from 1 to 2 carbon atoms.

4. The composite of claim 3 wherein the aminophosphonate ester of the flame and smolder retardant composition has the formula:

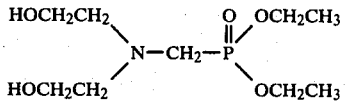

5. The composite of claim 3 wherein the aminophosphonate ester of the flame and smolder retardant composition has the formula:

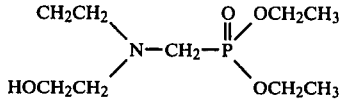

6. The composite of claim 3 wherein the aminophosphate ester of the flame and smolder retardant composition has the formula:

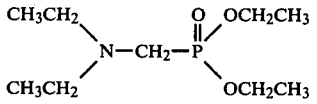

7. A composite upholstered furniture or mattress assembly comprising layers of material wherein the inside surface of the outermost layer of material is backcoated with an effective amount of a flame and smolder retardant composition comprising an aminophosphonate ester having the formula:

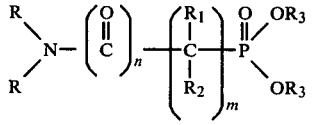

in combination with a thermosetting nitrogen containing resin and a reactive latex copolymer compound wherein R is an alkyl, hydroxyalkyl or haloalkyl radical containing from 1 to 3 carbon atoms, $R_1$ and $R_2$ are alkyl radicals containing 1 to 6 carbon atoms or hydrogen, $R_3$ which may be the same or different is an alkyl, hydroxyalkyl, haloalkyl, alkoxyalkyl, or hydroxyalkoxyalkyl radical containing from 1 to 6 carbon atoms, the terminus of an alkylene forming a six-membered ring or halogenated analog, the terminus of an alkylene or alkyleneoxyalkylene bonded to a like phosphorus ester group, hydroxypolyoxyalkylene or hydroxy-substituted analogs thereof, n is an integer from 0–1 and m is an integer of 1–2.

8. The composite of claim 7 wherein the aminophosphonate ester has the formula:

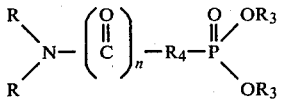

wherein R is an alkyl, hydroxyalkyl or haloalkyl radical containing from 1 to 3 carbon atoms, $R_3$ which may be the same or different is an alkyl radical containing from 1 to 6 carbon atoms, $R_4$ is a straight chain alkylene radical containing from 1 to 2 carbon atoms, and n is the integer of from 0 to 1.

9. The composite of claim 8 wherein the aminophosphonate ester has the formula:

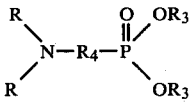

wherein R is an alkyl or hydroxyalkyl radical containing from 2 to 3 carbon atoms, $R_3$ which may be the same or different is an alkyl radical containing from 1 to 2 carbon atoms and $R_4$ is an alkylene radical containing 1 to 2 carbon atoms.

10. The composite of claim 9 wherein the aminophosphonate ester has the formula:

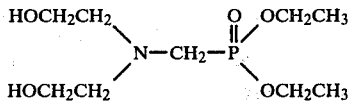

11. The composite of claim 9 wherein the aminophosphonate ester has the formula:

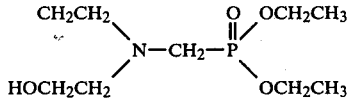

12. The composite of claim 9 wherein the aminophosphonate ester has the formula:

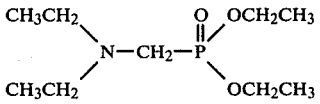

* * * * *

UNITED STATES PATENT AND TRADEMARK OFFICE

CERTIFICATE OF CORRECTION

PATENT NO. : 4,443,903

DATED : April 24, 1984

INVENTOR(S) : George J. Leitner

It is certified that error appears in the above—identified patent and that said Letters Patent is hereby corrected as shown below:

In the Abstract, Line 4, "aminophosponate" should be -- aminophosphonate --;
Col. 1, lines 57-58, "mexture" should be -- mixture --;
Col. 2, line 58, "nigrogen" should be -- nitrogen --;
Col. 2, line 68, "the" should be -- and --;
Col. 3, line 56, "nigrogen" should be -- nitrogen --;
Col. 5, line 4, "suchgroups" should be -- such groups --;
Col. 5, line 15, "nigrogen" should be -- nitrogen --;
Col. 5, lines 65-66, "synergisticaly" should be -- synergistically --;
Col. 5, line 67, "thermoseting" should be -- thermosetting --;
Col. 6, line 6, "lowering" should be -- lower --;
Col. 6, lines 60-61, "(ther-mo-setting)"should be -- (thermosetting) --;
Col. 8, line 31, "(Fyrol 6)" should be -- (FYROL 6) --;
Col. 8, line 50, delete parenthesis before "aminomethyl";
Col. 9, line 20, "14,000 cps." should be -- 14,400 cps. --;
Col. 10 (Claim 5), first line of formula, "$CH_2$-$CH_2$" should be -- $CH_3$-$CH_2$;
Col. 12 (Claim 11), first line of formula,"$CH_2$-$CH_2$" should be -- $CH_3$-$CH_2$.

Signed and Sealed this

*Eleventh* Day of *December 1984*

[SEAL]

*Attest:*

GERALD J. MOSSINGHOFF

*Attesting Officer* *Commissioner of Patents and Trademarks*